US005647233A

United States Patent [19]

Chung

[11] Patent Number: 5,647,233

[45] Date of Patent: Jul. 15, 1997

[54] DOOR LOCKING MECHANISM

[76] Inventor: Kuan-Chin Chung, No. 91, Chu Shan Rd., Ho Hsin Tsun, Nei Pu Hsiang, Ping Tung Hsien, Taiwan

[21] Appl. No.: 533,258

[22] Filed: Sep. 25, 1995

[51] Int. Cl.[6] ..... E05B 65/00

[52] U.S. Cl. ..... 70/93; 292/264; 292/341.17

[58] Field of Search ..... 70/91, 93; 292/262, 292/264, 277, 340, 341.15, 341.17

[56] References Cited

U.S. PATENT DOCUMENTS

| | | | |
|---|---|---|---|
| 3,600,021 | 8/1971 | Hawkins | 292/341.17 |
| 3,657,908 | 4/1972 | Schwartz et al. | 70/93 |
| 3,763,673 | 10/1973 | Colombo et al. | 70/93 |
| 4,027,907 | 6/1977 | Crepinsek | 292/264 |
| 4,355,830 | 10/1982 | Rau, III | 292/341.17 |
| 4,577,896 | 3/1986 | Crepinsek | 292/264 |
| 4,580,819 | 4/1986 | Crepinsek | 292/264 |
| 4,580,820 | 4/1986 | Baber | 292/264 |

FOREIGN PATENT DOCUMENTS

| | | | |
|---|---|---|---|
| 718626 | 9/1965 | Canada | 70/93 |
| 1499959 | 9/1967 | France | 70/93 |
| 1516093 | 6/1978 | United Kingdom | 292/264 |

*Primary Examiner*—Darnell M. Boucher
*Attorney, Agent, or Firm*—Charles E. Baxley, Esq.

[57] ABSTRACT

A door locking device includes a housing having a lateral hole and a stop rotatably engaged in the lateral hole. A chain has one end secured to a door panel and has a head secured to the other end for engaging in the slot. A latch is extendible inward of the lateral hole for engaging with the stop. The head is movable over the stop into the slot when the latch is engaged with the stop and is prevented from moving over the stop by the latch so as to be prevented from disengaging from the slot. The door panel may be opened for a small gap only when the users are not home.

4 Claims, 4 Drawing Sheets

DOOR LOCKING MECHANISM

BACKGROUND OF THE INVENTION

1. Field of the Invention

The present invention relates to a lock, and more particularly to a door locking mechanism.

2. Description of the Prior Art

Typical door locking mechanisms comprise a panel secured in the door and having a slot formed therein, and a chain having one end secured to the wall member and having the other end engaged in the slot for allowing the door to be opened for a small gap and for preventing the door from being widely opened. However, such a locking mechanism should be locked from inside of the house and may not be used when the users are away from home.

The present invention has arisen to mitigate and/or obviate the afore-described disadvantages of the conventional door locking mechanisms.

SUMMARY OF THE INVENTION

The primary objective of the present invention is to provide a door locking mechanism which allows the door to be opened for a small gap and which may be locked when the users are away from home.

In accordance with one aspect of the invention, there is provided a door locking mechanism comprising a housing including an upper portion having a vertical hole formed therein and including a lower portion having a lateral hole formed therein and including a puncture communicating the vertical hole with the lateral hole, the housing including a side portion having a slot formed therein and communicating with the lateral hole, the slot including an open end, a stop rotatably engaged in the housing and engaged in the lateral hole, the stop being rotatable in a first direction and rotatable in a reverse direction, a chain means including a first end for securing to a door panel and including a second end having a head secured thereto, the head being engaged in the slot via the open end of the slot and movable over the stop when the stop rotates in the first direction, and a latch means slidably engaged in the puncture and extendible inward of the lateral hole for engaging with the stop and for preventing the stop from rotating in the reverse direction so as to retain the head in the slot. The head is movable over the stop into the slot when the latch means is engaged with the stop, and the head is prevented from moving over the stop so as to be prevented from disengaging from the slot, and the head is allowed to move over the stop and allowed to be disengaged from the slot when the latch means is disengaged from the stop.

The stop includes an axle rotatably supported in the housing and includes a biasing means for biasing the stop to engage in the lateral hole.

A lock means is slidably engaged in the vertical hole, the latch means is secured to the lock means and moving in concert with the lock means.

The housing includes an opening formed therein, the lock means includes a catch means for engaging with the opening so as to retain the latch means in the lateral hole.

The housing includes a groove communicating with the opening, the lock means includes a projection means extended from the catch means for slidably engaging with the groove when the catch means is disengaged from the opening.

A biasing means may bias the lock means away from the puncture and for disengaging the latch means from the stop.

A casing includes a block slidably received therein for securing to the first end of the chain means, and a biasing means may bias the block inwards of the casing so as to receive the chain means in the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
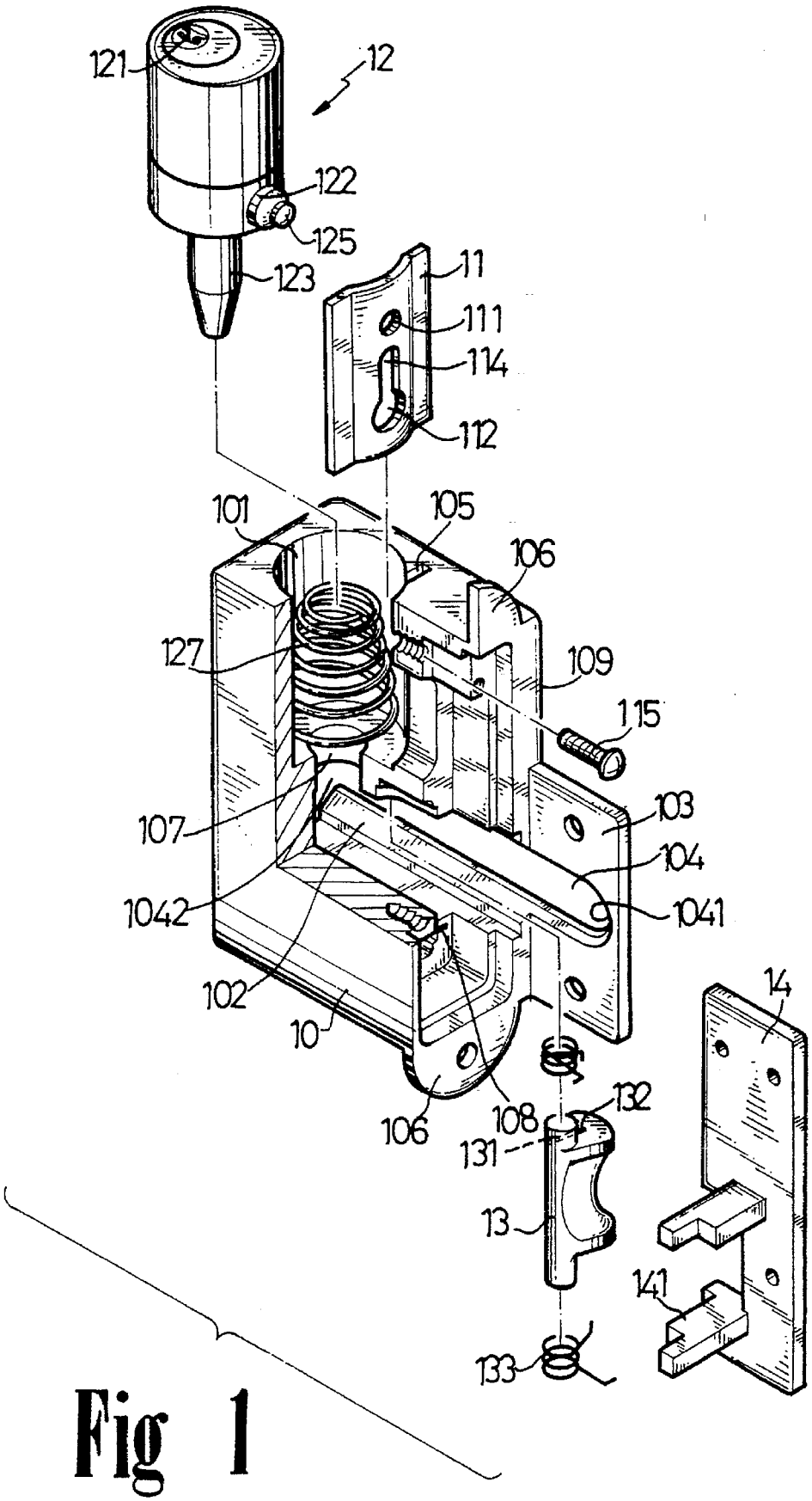
FIG. 1 is an exploded view of a door locking mechanism in accordance with the present invention, in which a portion of the door locking mechanism is cutout.
Figure 2:
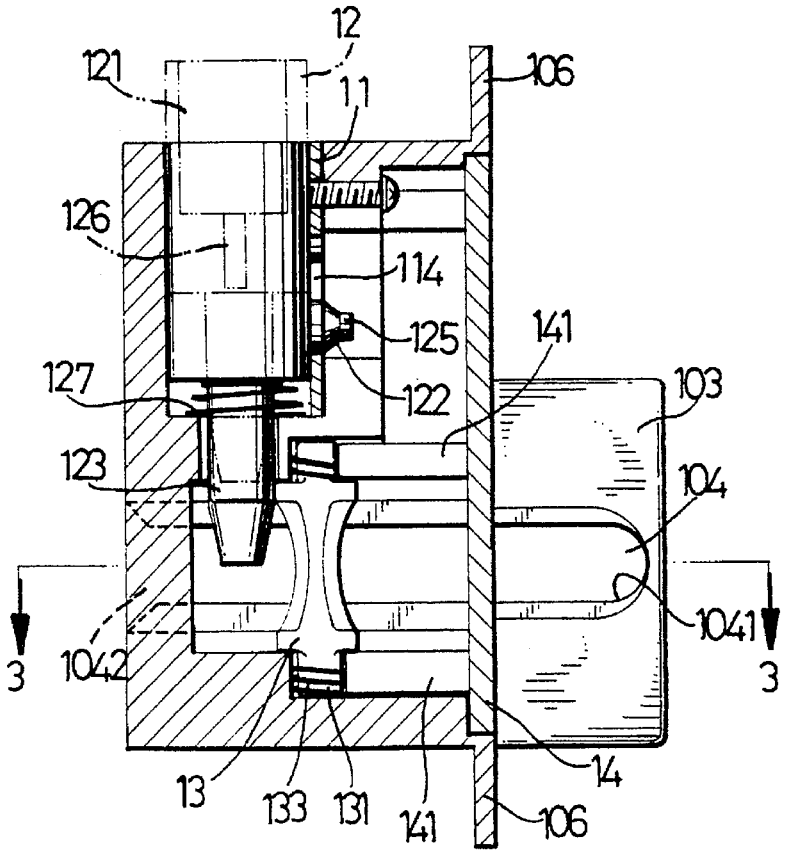
FIG. 2 is a cross sectional view taken along lines 2—2 of FIG. 3.
Figure 3:
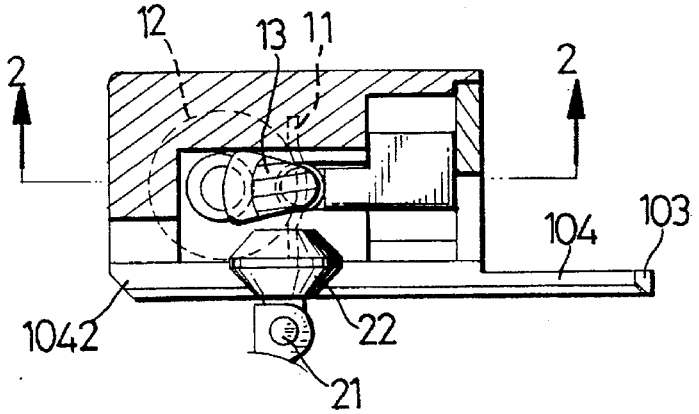
FIG. 3 is a cross sectional view taken along lines 3—3 of FIG. 2.

Referring to the drawings, and initially to FIGS. 1 to 3, a door locking mechanism in accordance with the present invention comprises a housing 10 including a vertical hole 101 formed in the upper portion and including a lateral hole 102 formed in the lower portion and including a puncture 107 communicating the vertical hole 101 with the lateral hole 102. The housing 10 includes two flanges 106 extended therefrom for securing to a wall member 31 (FIG. 5). The housing 10 includes an ear 103 secured thereto and includes a rear portion 109 having a slot 104 formed therein and communicating with the lateral hole 102. The slot 104 extends into the ear 103 and includes an enclosed end 1041 and an open end 1042, best shown in FIG. 4. The housing 10 includes a recess 108 formed therein and includes a channel 105 formed beside the vertical hole 101 for engaging with a panel 11 which includes a hole 111 formed therein and includes an opening 112 formed therein and includes a groove 114 formed therein and communicating with the opening 112 so as to form a key hole. A screw 115 is threaded into the housing 10 and engaged with the hole 111 so as to secure the panel 11 to the housing 10.

A spring 127 is received in the vertical hole 101 and a lock device 12 is slidably engaged in the vertical hole 101 and engaged on the spring 127. The lock device 12 includes a latch 123 extended in the puncture 107 and extendible downward into the lateral hole 102, best shown in FIG. 2. The lock device 12 includes a catch 122 extended laterally outward therefrom for engaging with the opening 112 of the key hole of the panel 11 and includes a projection 125 extended from the catch 122 for slidably engaging with the groove 114 so as to guide the lock device 12 to move up and down along the groove 114 and so as to prevent the lock device 12 from disengaging from the housing 10. The lock device 12 includes a core 121 which is rotatable by a key member. The core 121 includes an actuating rod 126 extended therefrom for engaging with the catch 122 and for moving the catch 122 outward to engage with the opening 112 so as to lock the lock device 12 in a downward position, and for allowing the catch 122 to move inward of the lock device 12 so as to allow the lock device 12 to move to an upper position.

A stop 13 includes an axle 131 rotatably engaged in the housing 10. Two springs 133 are engaged on the axle 131 and include one end engaged in the hole 132 of the stop 13 and include another end engaged in the recess 108 of the housing 10. The springs 133 bias the stop 13 to engage in the lateral hole 102 and allows the stop 13 to rotate in one direction and to rotate in a reverse direction. A cap 14 is secured to the housing 10 and includes two legs 141 extended inward of the housing 10 for engaging with the springs 133 and the axle 131 so as to stably retain the axle 131 in place, best shown in FIG. 2. As also shown in FIG. 2, when the latch 123 of the lock device 12 is moved inward of the lateral hole 102, the latch 123 may engage with the stop 13 so as to prevent the stop 13 from rotating toward the open end 1042 of the slot 104 and so as to allow the stop 13 to rotate toward the enclosed end 1041 of the slot 104 only. However, as shown in FIG. 3, when the latch 123 extends upward into the puncture 107 of the housing 10 and is disengaged from the stop 13, the stop 13 is allowed to rotate toward the open end 1042 of the slot 104.

Referring next to FIG. 5, a casing 20 is secured to the door panel 30 and includes a block 24 slidably engaged therein. A chain 21 has one end secured to the block 24 and has the other end movable outward of the casing 20 and has a head 22 secured to the other end thereof. A spring 25 is biased between the casing 20 and the block 24 so as to move the block 24 inward of the casing 20 and so as to receive the chain 21 in the casing 20. The head 22 and the chain 21 may be pulled away from the casing 20 against the spring 25.

Figure 4:
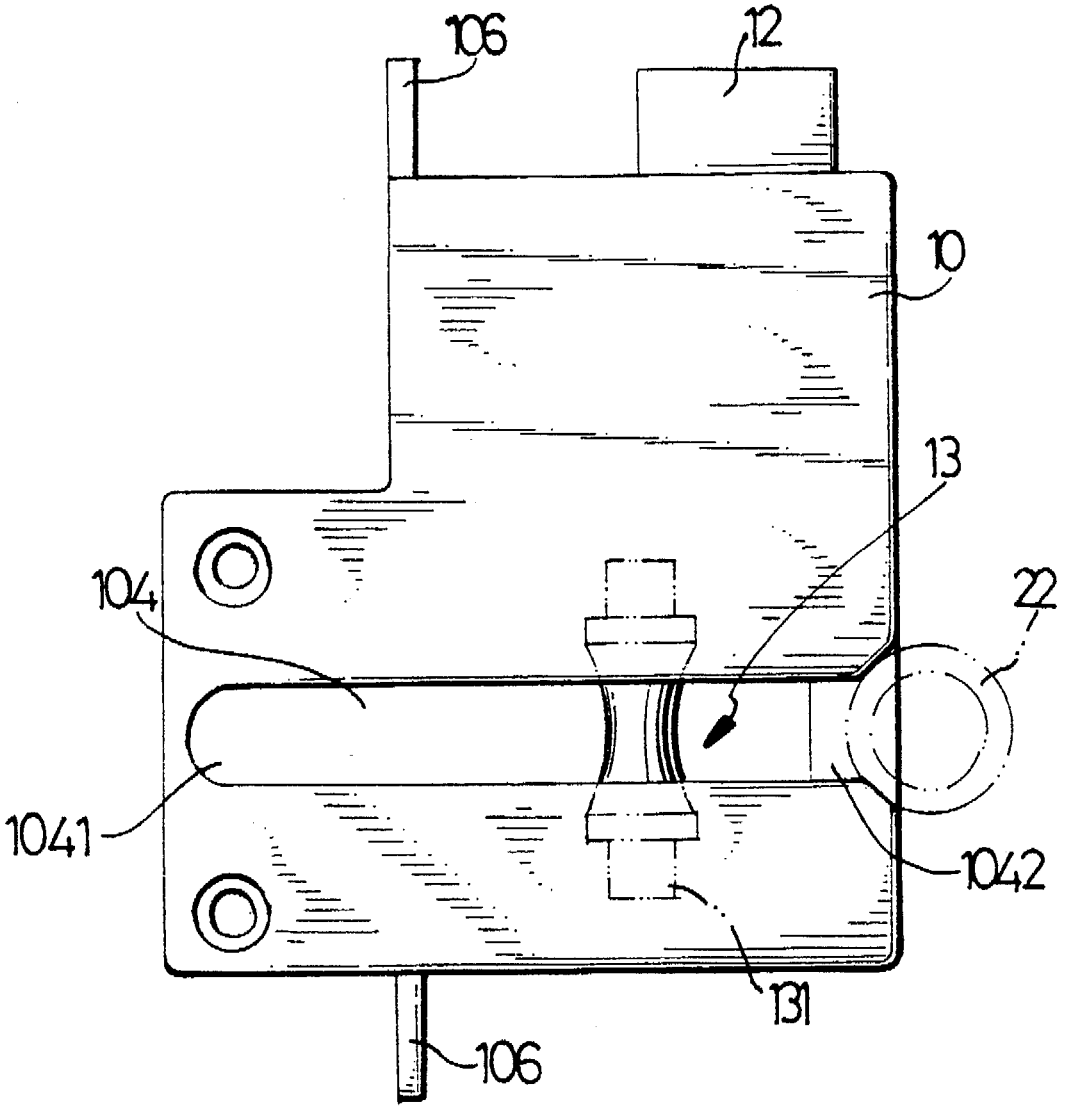
FIG. 4 is a rear view of the door locking mechanism.
Figure 5:
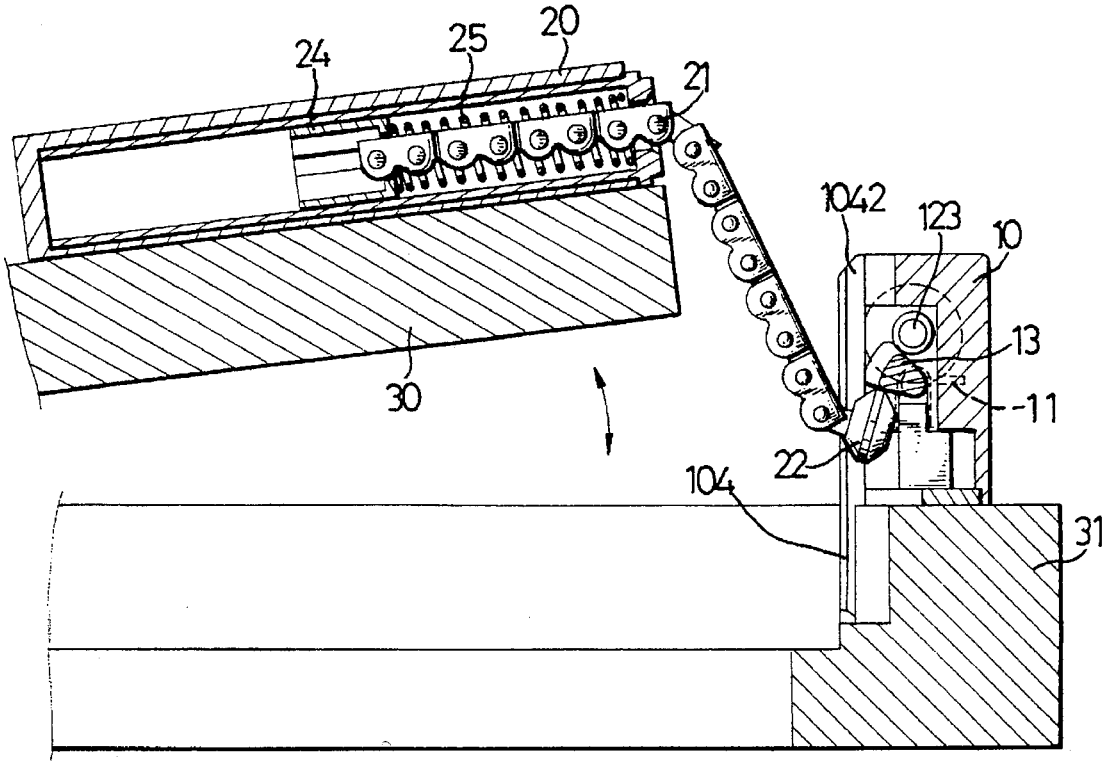
FIG. 5 is a schematic view illustrating the operation of the door locking mechanism.

In operation, as shown in FIGS. 3 to 5, the head 22 may be engaged in the slot 104 via the open end 1042 of the slot 104 and may be engaged with the closed end 1041 of the slot 104. When the latch 123 is disengaged from the stop 13, the stop 13 may be rotated by the head 22 such that the head 22 may move over the stop 13 (FIG. 3). However, as shown in FIGS. 2 and 5, when the latch 123 is moved downward into the lateral hole 102 to engage with the stop 13, the stop 13 is prevented from rotating toward the open end 1042 of the slot 104 such that the head 22 can be retained in the slot 104 and can not be disengaged from the slot 104. At this moment, the door panel 30 may be opened for a small gap only, best shown in FIG. 5.

It is to be noted that the lock device 12 may be depressed inward of the vertical hole 101 before the users go out of the house. When the door panel 30 is closed, the head 22 may also move into the slot 104 and may also move over the stop 13. However, the head 22 is retained in the slot 104 after moving over the stop 13 such that the door panel 30 can be opened for a small gap only. Any unauthorized person may think that somebody must be in the house and will not break into the house. The users, at this time, may engage the key into the core 121 of the lock device 12 in order to unlock the lock device 12 and in order to disengage the latch 123 from the stop 13 such that the head 22 may be moved over the stop 13 when the latch 123 is disengaged from the stop 13. The door locking mechanism may be used as the primary door lock or may be used as an auxiliary door lock.

Accordingly, the door locking mechanism in accordance with the present invention allows the door to be opened for a small gap only when the users go out such that the unauthorized persons may think that somebody must be in the house and will not break into the house.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door locking mechanism comprising:

a housing including an upper portion having a vertical hole formed therein and including a lower portion having a lateral hole formed therein and including a puncture communicating said vertical hole with said lateral hole, said housing including a side portion having a slot formed therein and communicating with said lateral hole, said slot including an open end, a stop rotatably engaged in said housing and engaged in said lateral hole, said stop being rotatable in a first direction and rotatable in a reverse direction, a chain means including a first end for securing a door panel and including a second end having a head secured thereto, said head being engaged in said slot via said open end of said slot and movable over said stop when said stop rotates in said first direction, a casing secured to the door panel and including a block slidably received therein for securing to said first end of said chain means, and means for biasing said block inwards of said casing so as to receive said chain means in said casing, a latch means slidably engaged in said puncture and extendible inward of said lateral hole for engaging with said stop and for preventing said stop from rotating in said reverse direction so as to retain said head of said chain means in said slot, a lock means slidable engaged in said vertical hole and being secured to said latch means to move therewith, means for biasing said lock means away from said puncture and for disengaging said latch means from said stop, and said head being movable over said stop into said slot when said latch means is engaged with said stop, and said head being prevented from moving over said stop so as to be prevented from disengaging from said slot, and said head being allowed to move over said stop and allowed to be disengaged from said slot when said latch means is disengaged from said stop.

2. A door locking mechanism according to claim 1, wherein said stop includes an axle rotatably supported in said housing and includes a biasing means for biasing said stop to engage in said lateral hole.

3. A door locking mechanism according to claim 1, wherein said housing includes an opening formed therein, said lock means includes a catch means for engaging with said opening so as to retain said latch means in said lateral hole.

4. A door locking mechanism according to claim 3, wherein said housing includes a groove communicating with said opening, said lock means includes a projection means extended from said catch means for slidably engaging with said groove when said catch means is disengaged from said opening.

* * * * *